US007780426B2

(12) United States Patent
Cho et al.

(10) Patent No.: US 7,780,426 B2
(45) Date of Patent: Aug. 24, 2010

(54) ROTARY COMPRESSOR DEFINING GAPS OF DIFFERENT SIZES

(75) Inventors: Kyung Rae Cho, Suwon-si (KR); Phil Soo Chang, Seongnam-si (KR); Hyeong Joon Seo, Suwon-si (KR); In Ju Lee, Yongin-si (KR); Ji Hoon Choi, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 304 days.

(21) Appl. No.: 11/979,928

(22) Filed: Nov. 9, 2007

(65) Prior Publication Data

US 2008/0193314 A1 Aug. 14, 2008

(30) Foreign Application Priority Data

Feb. 14, 2007 (KR) ..... 10-2007-0015616

(51) Int. Cl.
*F03C 2/00* (2006.01)
*F03C 4/00* (2006.01)
*F04C 2/00* (2006.01)

(52) U.S. Cl. ..... 418/11; 418/23; 418/60; 418/63; 418/150; 418/270

(58) Field of Classification Search ..... 418/11, 418/23–27, 60, 63, 270, 150
See application file for complete search history.

(56) References Cited

U.S. PATENT DOCUMENTS 6,716,007 B2 * 4/2004 Kim et al. ..... 418/23
7,563,084 B2 * 7/2009 Kurita et al. ..... 418/60

FOREIGN PATENT DOCUMENTS

JP 57176686 U * 8/1982
JP 01247786 A * 10/1989 ..... 418/23
KR 10-0621026 8/2006

OTHER PUBLICATIONS

Chinese Office Action for corresponding Chinese Patent Application No. 2007101968240 dated Jun. 19, 2009, 4 pgs.

* cited by examiner

*Primary Examiner*—Theresa Trieu
(74) *Attorney, Agent, or Firm*—Staas & Halsey LLP

(57) ABSTRACT

A rotary compressor including a housing having first and second compressing chambers separated from each other, first and second flanges coupled to the housing, to close the first and second compressing chambers, respectively, an intermediate plate to separate the first and second compressing chambers from each other, first and second rollers rotatably installed in the first and second compressing chambers, respectively, first and second vanes to reciprocate in a radial direction of the first and second compressing chambers to divide the first and second compressing chambers, respectively, and a vane control device to control the reciprocating movement of the first vane by use of a suction pressure and a discharge pressure, for a variation in compression capacity. A first gap, defined at an end of the first roller, is smaller than a second gap defined at an end of the second roller.

3 Claims, 10 Drawing Sheets

ROTARY COMPRESSOR DEFINING GAPS OF DIFFERENT SIZES

CROSS-REFERENCE TO RELATED APPLICATIONS

This application claims the benefit of Korean Patent Application No. 10-2007-0015616, filed on Feb. 14, 2007 in the Korean Intellectual Property Office, the disclosure of which is incorporated herein by reference.

BACKGROUND

1. Field

The present invention relates to a rotary compressor, and, more particularly, to a rotary compressor, which can improve the sealing effect of a compressing chamber and minimize the introduction of a refrigerant or oil into the compressing chamber while an idling-rotation operation is performed in the compressing chamber.

2. Description of the Related Art

Korean Patent Registration No. 10-0621026 (published on Sep. 15, 2006) discloses a multiple rotary compressor comprising: an upper first compressing chamber and a lower second compressing chamber separated from each other; and first and second rollers rotating in the respective compressing chambers to perform a compressing operation in the compressing chambers, respectively. The conventional rotary compressor further includes: a first vane to divide the upper first compressing chamber; a second vane to divide the lower second compressing chamber; and a vane control device to selectively restrict or release the second vane, for achieving a variable compression capacity.

The vane control device restricts the second vane by applying a suction pressure into a back-pressure space defined by the second vane, or reciprocates the second vane by applying a discharge pressure into the back-pressure space. By controlling the operation of the second vane as described above, the vane control device causes a compressing-rotation operation or idling-rotation operation in the second compressing chamber, so as to achieve a variation in compression capacity.

However, in the above described conventional rotary compressor, when the first compressing chamber performs a compressing-rotation operation and the second compressing chamber performs an idling-rotation operation, the inner pressure of the second compressing chamber is lower than the inner pressure of a hermetic container, therefore a liquid mixture of compressed refrigerant and oil inside the hermetic container may be unintentionally introduced into the second compressing chamber. Specifically, the liquid mixture of compressed refrigerant and oil may be introduced into the second compressing chamber through gaps defined at upper and lower ends of the second roller. Once the liquid mixture of compressed refrigerant and oil is introduced into the second compressing chamber, it acts as a rotation load, and may result in deterioration in the efficiency of the compressor. Furthermore, while the respective compressing chambers perform a compressing-rotation operation, a compressed refrigerant gas may leak through the gaps defined at the upper and lower ends of the respective rollers, therefore the above described rotary compressor may have deterioration in compression efficiency.

SUMMARY

Accordingly, it is an aspect of the present invention to solve the above problems.

It is another aspect of the present invention to provide a rotary compressor capable of improving the sealing effect of a compressing chamber and thus, minimizing the introduction of a refrigerant or oil into the compressing chamber while an idling-rotation operation is performed in the compressing chamber.

Additional aspects and/or advantages will be set forth in part in the description which follows and, in part, will be apparent from the description, or may be learned by practice of the invention.

It is a further aspect of the invention to provide a rotary compressor capable of improving the sealing effect of a compressing chamber and consequently, achieving an improvement in compression efficiency.

The foregoing and/or other aspects are achieved by providing a rotary compressor comprising: a housing defining first and second compressing chambers separated from each other; first and second flanges coupled to the housing, to close the first and second compressing chambers, respectively; an intermediate plate to separate the first and second compressing chambers from each other; first and second rollers rotatably installed in the first and second compressing chambers, respectively; first and second vanes installed to reciprocate in a radial direction of the first and second compressing chambers, to divide the first and second compressing chambers, respectively; and a vane control device to control the reciprocating of the first vane by use of a suction pressure and a discharge pressure, to vary a compression capacity, wherein a first gap, defined at an end of the first roller between the first roller and the first flange, is smaller than a second gap defined at an end of the second roller between the second roller and the second flange.

The width of the first gap may be determined on the basis of the equation $d1=d2*[1-V1/(V1+V2)]$, where $d2$ is the width of the second gap, $V1$ is the volume of the first compressing chamber, and $V2$ is the volume of the second compressing chamber.

The vane control device may comprise: a control valve to a selectively apply the discharge pressure or the suction pressure into a space defined at the rear side of the first vane; a connection channel to connect the control valve to the space at the rear side of the first vane; a high-pressure channel to connect the control valve to a discharge side of the compressor; and a low-pressure channel to connect the control valve to a suction side of the compressor.

The foregoing and/or other aspects are achieved by providing a rotary compressor comprising: a housing having first and second compressing chambers separated from each other; first and second flanges coupled to the housing, so as to close the first and second compressing chambers, respectively; an intermediate plate to separate the first and second compressing chambers from each other; first and second rollers rotatably installed in the first and second compressing chambers, respectively; first and second vanes installed to reciprocate in a radial direction of the first and second compressing chambers, so as to divide the first and second compressing chambers, respectively; a vane control device to control the reciprocating movement of the first vane by use of a suction pressure and a discharge pressure, for a variation in compression capacity; and sealing devices provided at both ends of the first roller, respectively, to seal between the first roller and the first flange and between the first roller and the intermediate plate, wherein each of the sealing devices includes: a sealing recess formed in the first roller; a sealing ring received in the sealing recess and adapted to reciprocally move to come into close contact with the first flange or intermediate plate; and a ring-shaped pressure spring installed in the sealing recess, to press the sealing ring to the first flange or intermediate plate.

The pressure spring may have a semicircular cross section.

The foregoing and/or other aspects are achieved by providing a rotary compressor comprising: a housing having a compressing chamber; a plurality of flanges coupled to the housing, to close the compressing chamber; a roller rotating in the compressing chamber; and a plurality of sealing devices at upper and lower ends of the roller, respectively, to seal between inner surfaces of the respective flanges and the roller, wherein each of the sealing devices includes: a sealing recess formed in the roller, a sealing ring received in the sealing recess to reciprocally move to come into close contact with the inner surface of the respective flange, and a ring-shaped pressure spring installed in the sealing recess, to press the sealing ring to the flange.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
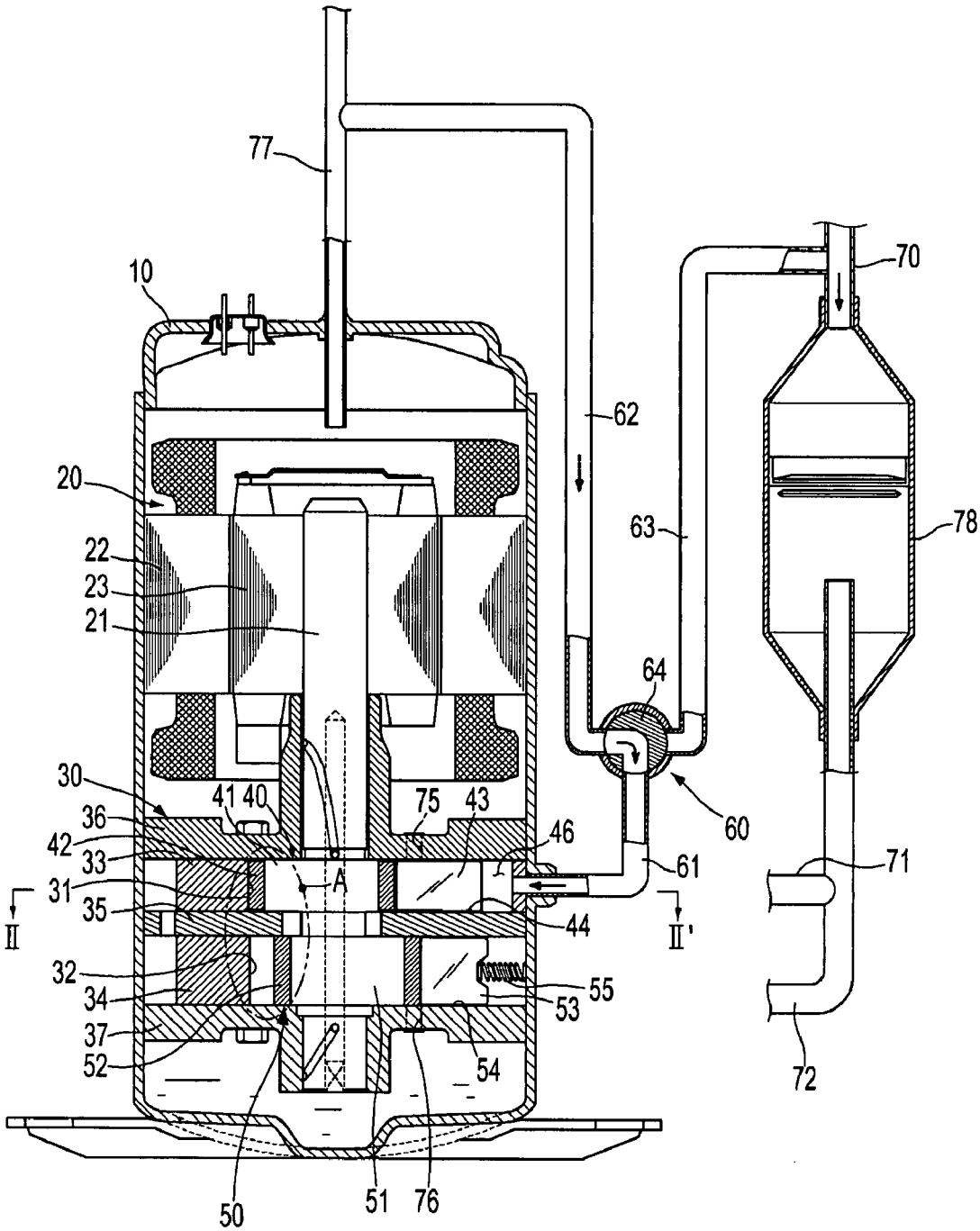
FIG. 1 is a sectional view of a rotary compressor in accordance with a first embodiment of the present invention, illustrating a state wherein a compressing-rotation operation is performed in a first compressing chamber.

Reference will now be made in detail to the embodiments, examples of which are illustrated in the accompanying drawings, wherein like reference numerals refer to the like elements throughout. The embodiments are described below to explain the present invention by referring to the figures.

FIGS. 1 to 5 illustrate a rotary compressor in accordance with a first embodiment of the present invention. The rotary compressor, as shown in FIG. 1, includes a hermetic container 10, an electric motor device 20 arranged in an upper region of the hermetic container 10, and a compression device 30 arranged in a lower region of the hermetic container 10, the compression device 30 being connected to the electric motor device 20 by a rotating shaft 21.

The electric motor device 20 includes a cylindrical stator 22 attached to an inner surface of the hermetic container 10, and a rotor 23 rotatably mounted inside the stator 22, the rotor 23 being centrally coupled around the rotating shaft 21. As the rotor 23 is rotated upon receiving electric power applied to the electric motor device 20, the electric motor device 20 operates the compression device 30 connected thereto by the rotating shaft 21.

The compression device 30 includes a housing having an upper first compressing chamber 31 and a lower second compressing chamber 32 separated from each other, and first and second compressing units 40 and 50 arranged in the first and second compressing chambers 31 and 32, respectively, the first and second compressing units 40 and 50 being operated by the rotating shaft 21.

The housing of the compression device 30 includes a first housing 33 defining the first compressing chamber 31 therein, and a second housing 34 defining the second compressing chamber 32 therein, the second housing 34 being located below the first housing 33. An intermediate plate 35 is installed between the first housing 33 and the second housing 34, to divide the first and second compressing chambers 31 and 32 from each other. A first flange 36 is attached to the top of the first housing 33 and a second flange 37 is attached to the bottom of the second housing 34. The first and second flanges 36 and 37 serve to close an upper opening of the first compressing chamber 31 and a lower opening of the second compressing chamber 32, respectively, and to support the rotating shaft 21. The rotating shaft 21 penetrates through the center of the first and second compressing chambers 31 and 32, and is connected to the compressing units 40 and 50 within the first and second compressing chambers 31 and 32.

The first compressing unit 40 includes a first eccentric portion 41 provided around the rotating shaft 21 inside the first compressing chamber 31, and a first roller 42 rotatably coupled to an outer surface of the first eccentric portion 41 so as to rotate in contact with an inner surface of the first compressing chamber 31. Similarly, the second compressing unit 50 includes a second eccentric portion 51 provided around the rotating shaft 21 inside the second compressing chamber 32, and a second roller 52 rotatably coupled to an outer surface of the second eccentric portion 51 so as to rotate in contact with an inner surface of the second compressing chamber 32. The first and second eccentric portions 41 and 51 are eccentrically arranged in opposite directions with respect to the rotating shaft 21, for the sake of maintaining balance.

Figure 2:
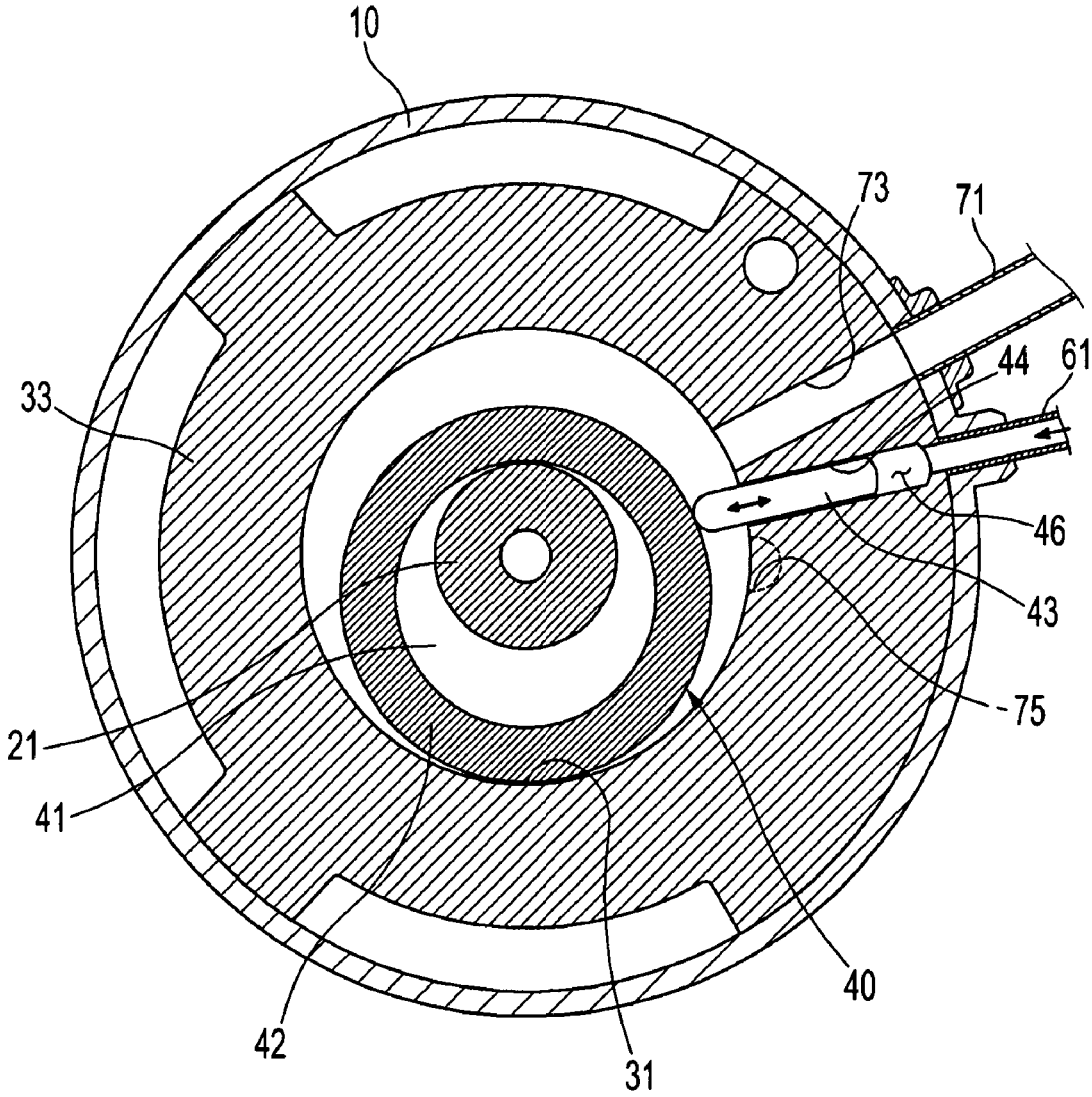
FIG. 2 is a sectional view taken along the line II-II' of FIG. 1.

The first and second compressing units 40 and 50 include first and second vanes 43 and 53, respectively. The first and second vanes 43 and 53 are adapted to reciprocate in a radial direction of the respective compressing chambers 31 and 32 in accordance with rotating movements of the first and second rollers 42 and 52, thereby serving to divide the respective compressing chambers 31 and 32. As shown in FIGS. 1 and 2, the first and second vanes 43 and 53 are received in first and second vane guiding grooves 44 and 54. Here, the first and second vane guiding grooves 44 and 54 extend lengthily in a radial direction of the respective compressing chambers 31 and 32, to guide reciprocating movements of the first and second vanes 43 and 53. The second vane guiding groove 54 receives a vane spring 55 therein. The vane spring 55 acts to press the second vane 53 toward the second roller 52 such that the second compressing chamber 32 is divided by the second vane 53.

A sealing chamber 46 is defined at the rear side of the first vane guiding groove 44, to receive a rear end of the first vane 43. The sealing chamber 46 is isolated from an internal space of the hermetic container 10 by the intermediate plate 35 and the first flange 36. A vane control device 60 is provided to restrict the first vane 43 at a rearwardly moved position by applying a suction pressure into the sealing chamber 46, or to allow reciprocating movements of the first vane 43 by applying a discharge pressure into the sealing chamber 46.

By restricting or releasing the first vane 43, the vane control device 60 accomplishes a compressing or idling-rotation operation within the first compressing chamber 31, thus enabling a variation in compression capacity. The vane control device 60, as shown in FIG. 1, includes a control valve 64 to convert a flow channel, a connection channel 61 to connect the control valve 64 to the first vane guiding groove 44, a high-pressure channel 62 to connect the control valve 64 to a discharge pipe 77, and a low-pressure channel 63 to connect the control valve 64 to a suction pipe 70. The control valve 64 coverts a flow channel to selectively communicate the connection channel 61 with the high-pressure channel 62 and the low-pressure channel 63, thereby allowing the suction pressure or discharge pressure to be selectively applied into the sealing chamber 46 defined at the rear side of the first vane guiding groove 44.

The first and second housings 33 and 34 have suction holes (designated by reference numeral 73, See FIG. 2) connected to suction channels 71 and 72, respectively, to suction gas into the first and second compressing chambers 31 and 32, and discharge holes 75 and 76 to discharge a compressed gas from the compressing chambers 31 and 32 into the hermetic container 10. With this configuration, during operation of the compressor, the internal space of the hermetic container 10 is kept at a high pressure by the compressed gas discharged through the discharge holes 75 and 76, and in turn, the compressed gas is discharged from the hermetic container 10 to the outside through the discharge pipe 77 located at the top of the hermetic container 10. Here, the gas, which is guided into the respective compressing chambers 31 and 32 via the suction channel 71 and 72, first passes an accumulator 78.

The capacity varying operation of the vane control device 60 is accomplished as follows.

Figure 3:
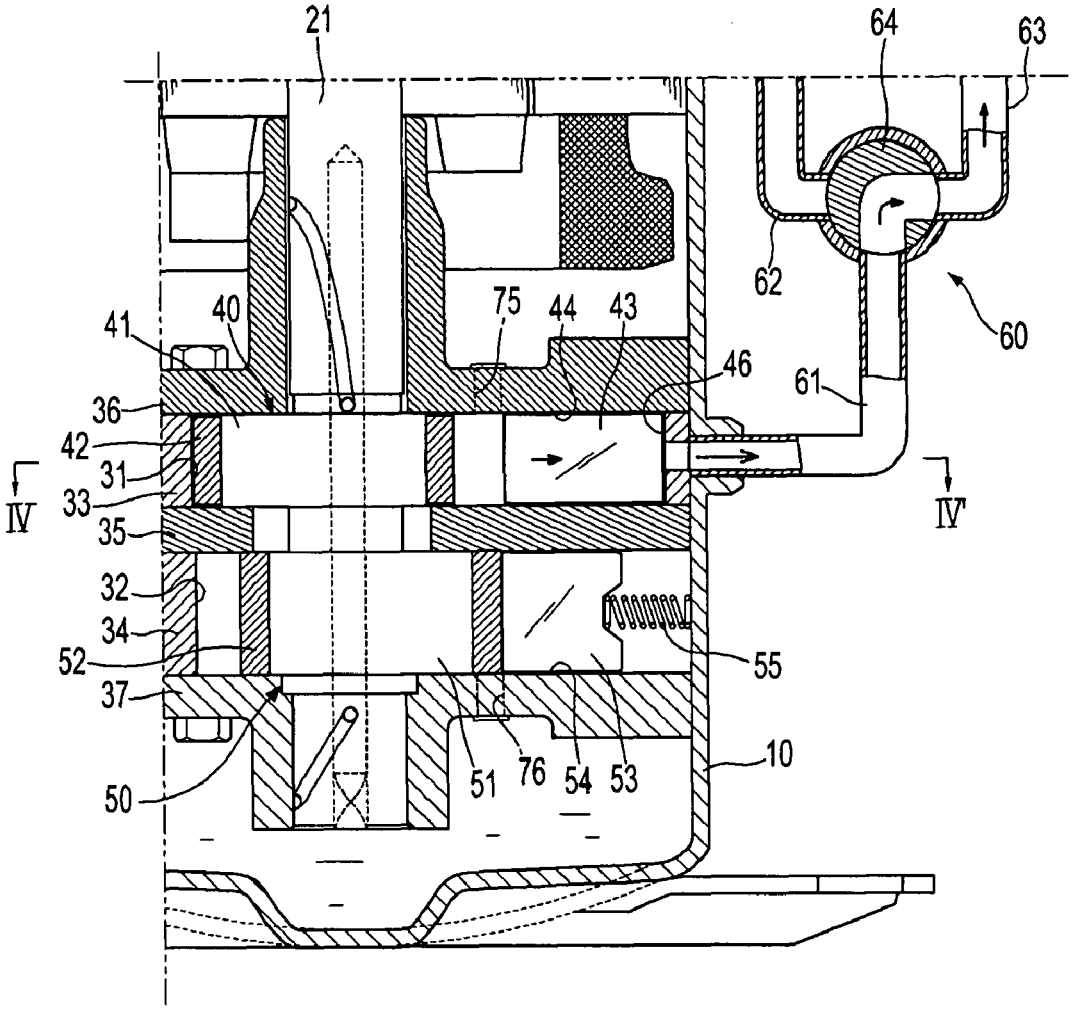
FIG. 3 is a sectional view of the rotary compressor in accordance with the first embodiment of the present invention, illustrating a state wherein an idling-rotation operation is performed in a first compressing chamber.
Figure 4:
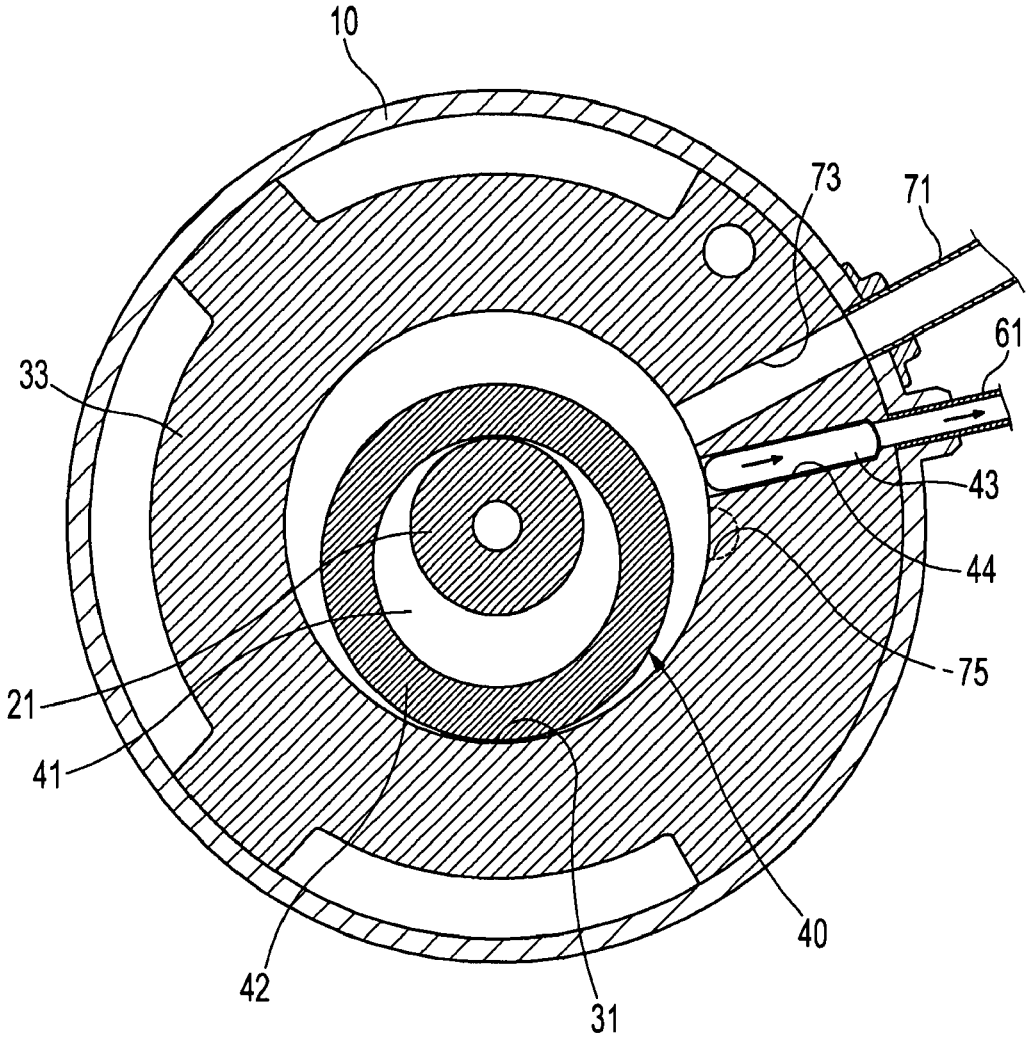
FIG. 4 is a sectional view taken along the line IV-IV' of FIG. 3.

As shown in FIGS. 1 and 2, when the control valve 64 operates to communicate the connection channel 61 with the high-pressure channel 62, the sealing chamber 46 is affected by the discharge pressure. Thus, the first vane 43 is pushed into the first compressing chamber 31 by the discharge pressure, thereby reciprocating according to eccentric-rotating movements of the first roller 42. On the other hand, as shown in FIGS. 3 and 4, when the control valve 64 operates to communicate the connecting channel 61 with the low-pressure channel 63, the sealing chamber 64 is affected by the suction pressure. Thus, the first vane 43 is restricted and stopped at a rearwardly moved position, thereby causing an idling-rotation operation in the first compressing chamber 31. In conclusion, a compressing or idling-rotation operation can be accomplished in the first compressing chamber 31 by restricting or releasing the first vane 43 under the control of the vane control device 60. Accordingly, the above described rotary compressor of the first embodiment can accomplish a variation in compression capacity.

Figure 5:
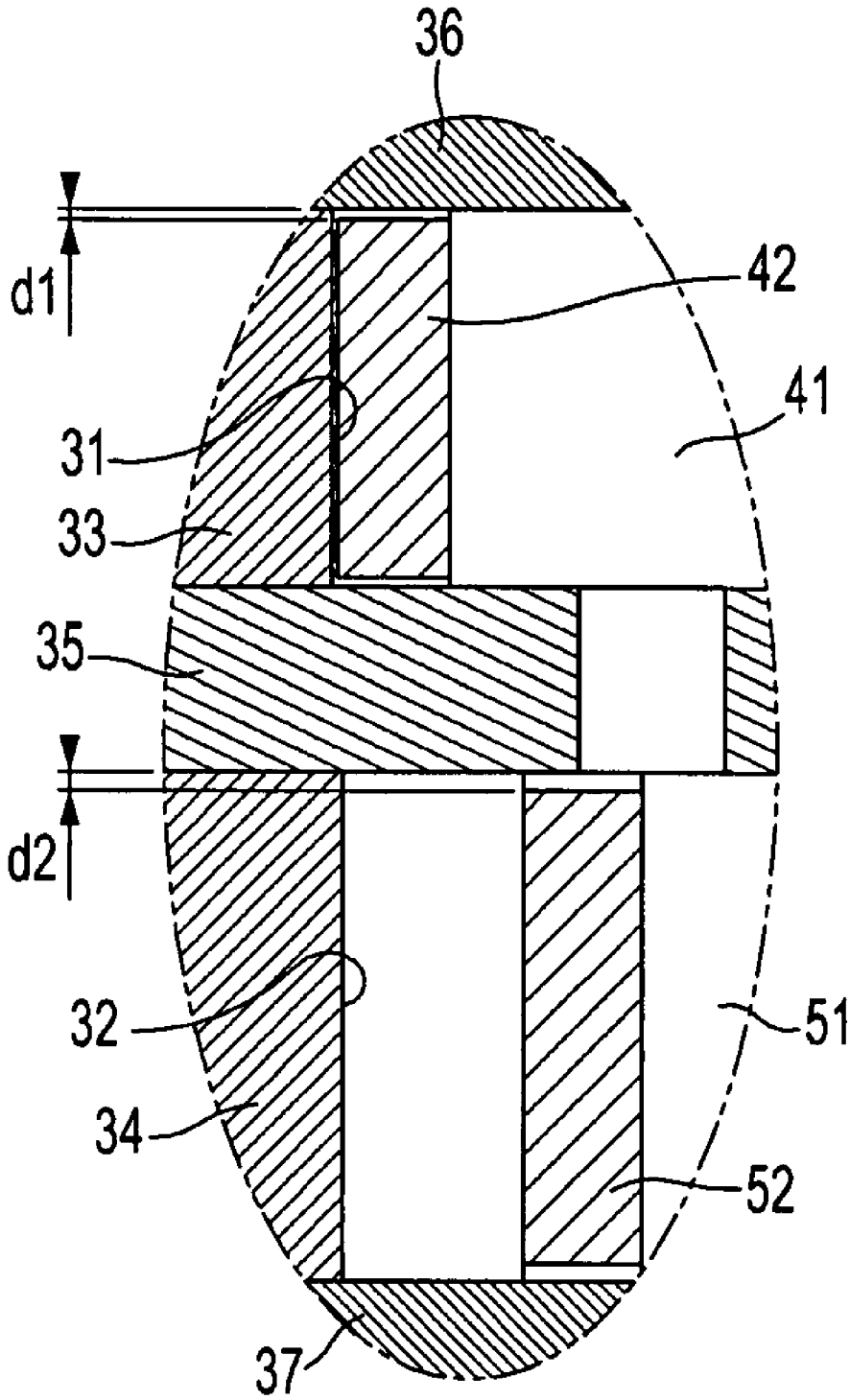
FIG. 5 is a detailed view of the portion A of FIG. 1.

Referring to FIG. 3, while an idling-rotation operation is performed in the first compressing chamber 31, the inner pressure of the first compressing chamber 31 is lower than the inner pressure of the hermetic container 10. In such a condition, the previously described conventional compressor has a problem in that a refrigerant or oil may be introduced into the first compressing chamber. To prevent a liquid mixture of refrigerant or oil from being introduced into the first compressing chamber under the above described condition, as shown in FIG. 5, this embodiment of the present invention proposes that a first gap d1, defined at an end of the first roller 42, is smaller than a second gap d2, defined at an end of the second roller 52. The first gap d1 is a gap between the first roller 42 and the first flange 36 or intermediate plate 35, and the second gap d2 is a gap between the second roller 52 and the intermediate plate 35 or second flange 37. The second gap d2 has the same width as that of a gap between a roller and a flange of a conventional rotary compressor. In FIG. 5, the gaps d1 and d2 are illustrated in exaggerated scales regardless of proportions of the surroundings, for convenience of description.

The width of the first gap d1 satisfies the equation $d1=d2*[1-V1/(V1+V2)]$. In this equation, d2 is the width of the second gap, V1 is the volume of the first compressing chamber 31, and V2 is the volume of second compressing chamber 32. For example, if the volume of the first compressing chamber is 30 cc, the volume of the second compressing chamber 32 is 70 cc, and the width of the second gap d2 is 20 μm the width of the first gap d1 can be calculated to 14 μm by 20 μm*[1−30/(30+70)].

With the above described configuration, the first gap d1 defined at the end of the first roller 42 is smaller than the second gap d2 defined at the second roller 52, and the first compressing chamber 31 can achieve improved sealing. Accordingly, even when an idling-rotation operation is performed in the first compressing chamber 31, it is possible to minimize the introduction of a refrigerant or oil into the first compressing chamber 31.

In a state wherein no liquid mixture of refrigerant and oil is introduced into the first compressing chamber 31, the rotating shaft 21 has a reduced rotation resistance, and consequently, the electric motor device 20 has a reduced operation load. This results in an improvement in the compression efficiency of the compressor. Moreover, more efficient sealing of the first compressing chamber 31 is possible while a compressing-rotation operation is performed in the first compressing chamber 31, therefore a further improvement in compression efficiency can be accomplished.

Figure 6:
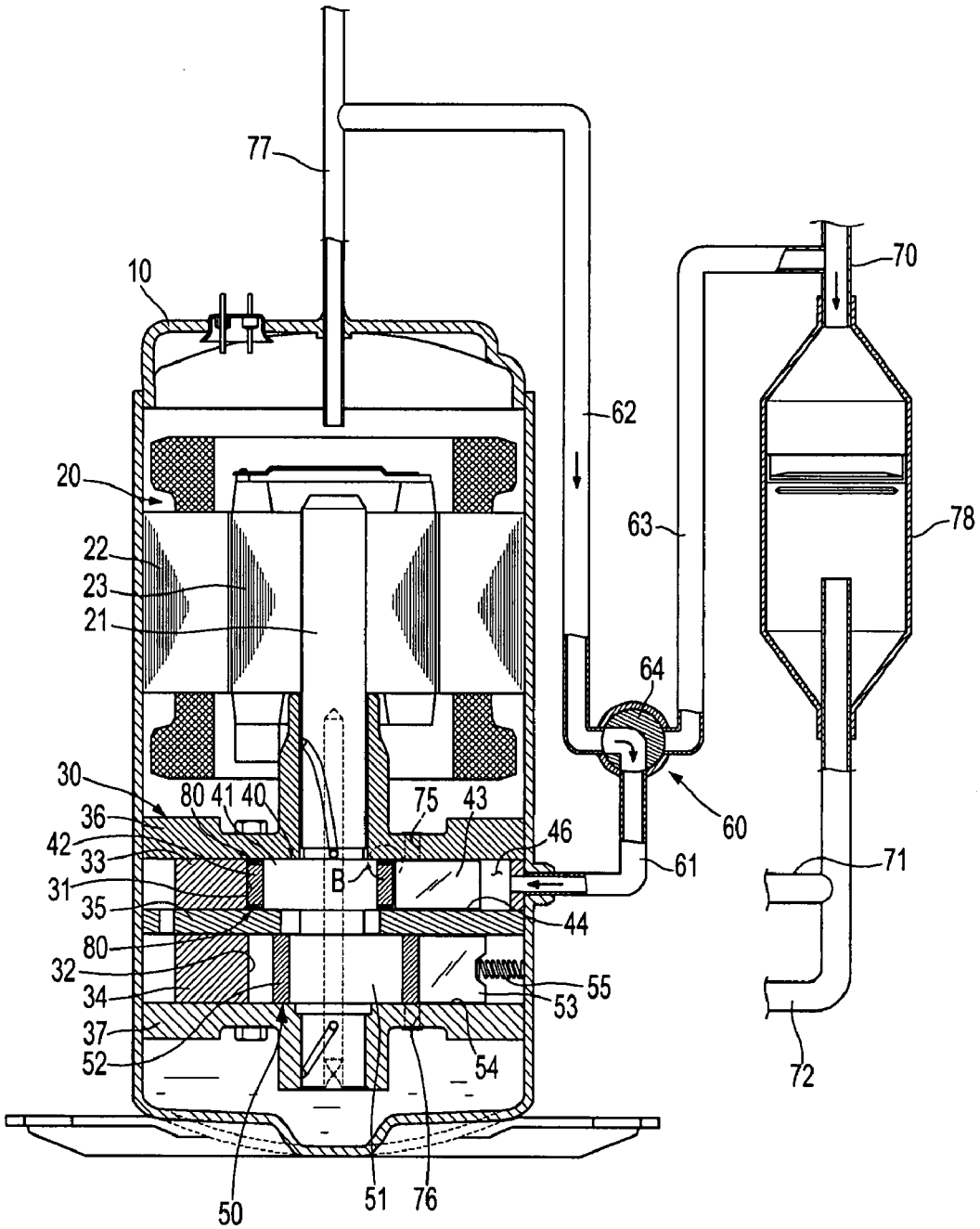
FIG. 6 is a sectional view of a rotary compressor in accordance with a second embodiment of the present invention.
Figure 7:
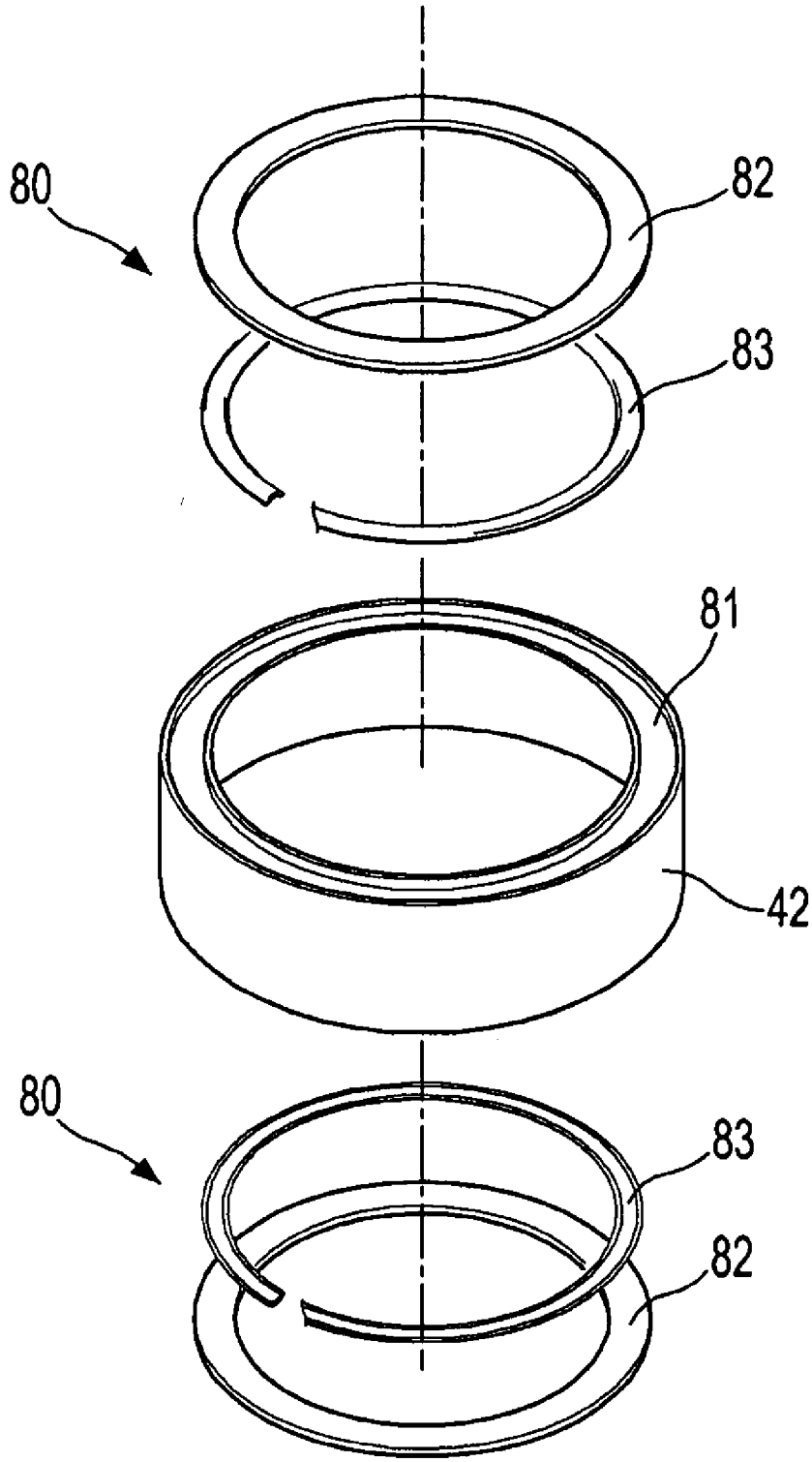
FIG. 7 is an exploded perspective view illustrating a sealing device included in the rotary compressor in accordance with the second embodiment of the present invention.
Figure 8:
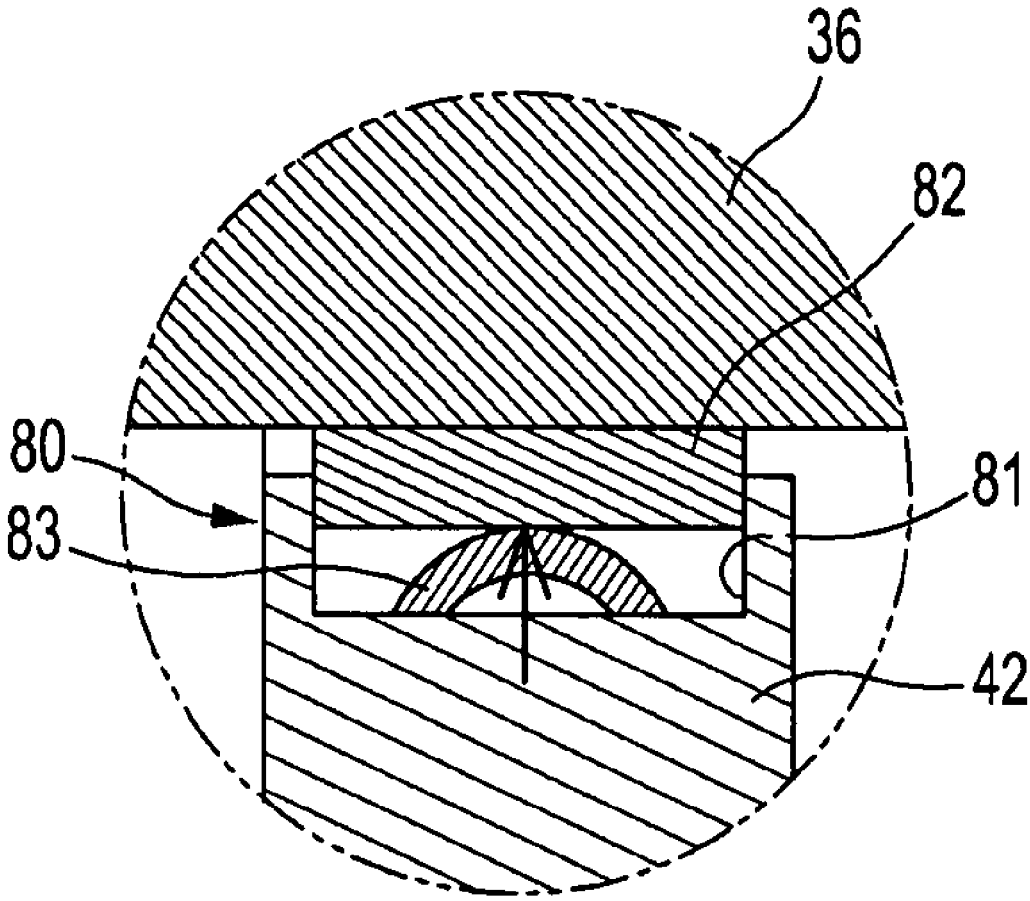
FIG. 8 is a detailed view of the portion B of FIG. 6.

FIGS. 6 to 8 illustrate a rotary compressor in accordance with a second embodiment of the present invention. The rotary compressor of the second embodiment includes sealing devices 80 provided at upper and lower ends of the first roller 42, to prevent the liquid mixture of refrigerant and oil from being introduced into the first compressing chamber 31. Other configurations of the second embodiment are similar to those of the previously described first embodiment. In FIGS. 6 to 8, the same constituent elements as those of the first embodiment are designated by the same reference numerals.

The sealing devices 80, as shown in FIGS. 7 and 8, include sealing recesses 81 formed in upper and lower ends of the first roller 42, sealing rings 82 received in the respective sealing recesses 81 and adapted to reciprocate upward and downward so as to come into close contact with the first flange 36 or intermediate plate 35, respectively, and pressure springs 83 installed in the sealing recesses 81, so as to press the respective sealing rings 82 to the first flange 36 or intermediate plate 35.

The pressure spring 83, as shown in FIG. 8, is a leaf spring having a semicircular cross section. Also, as shown in FIG. 7, the pressure spring 83 has a ring shape suitable to apply a uniform pressure to the overall sealing ring 82. By allowing the sealing ring 82 to come into close contact with the first flange 36 or intermediate plate 35 under the influence of elasticity of the pressure spring 83, the sealing effect of the first compressing chamber 31 can be improved. Accordingly, even while an idling-rotation operation is performed in the first compressing chamber 31, it is possible to minimize the introduction of a refrigerant or oil into the first compressing chamber 31.

In a state wherein no liquid mixture of refrigerant and oil is introduced into the first compressing chamber 31, the rotating shaft 21 has a reduced rotation resistance, and consequently, the electric motor device 20 has a reduced operation load. This results in an improvement in the compression efficiency of the compressor. Moreover, more efficient sealing of first compressing chamber 31 is possible while a compressing-rotation operation is performed in the first compressing chamber 31, and a further improvement in compression efficiency can be accomplished.

Figure 9:
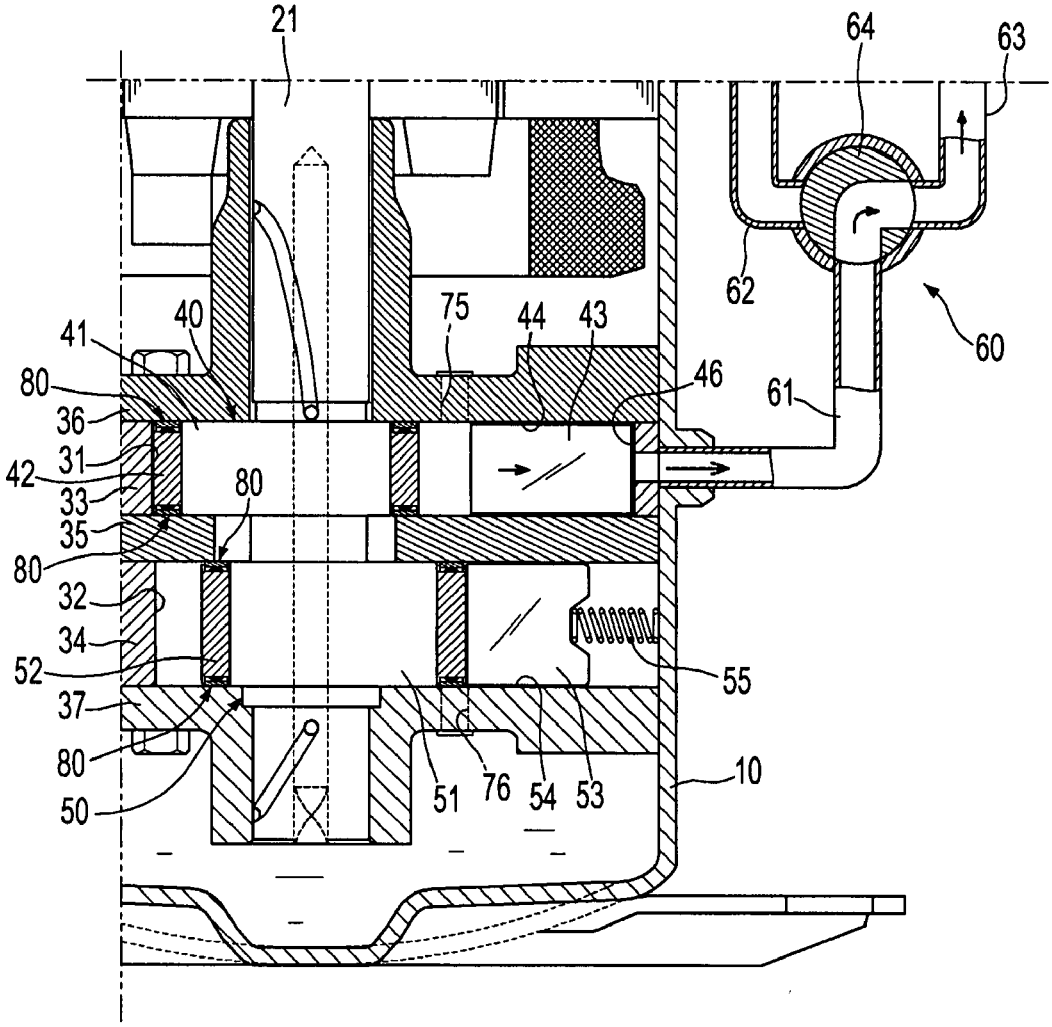
FIG. 9 is a sectional view of the rotary compressor in accordance with a third embodiment of the present invention.

FIG. 9 illustrates a rotary compressor in accordance with a third embodiment of the present invention. The rotary compressor of the third embodiment is different from that of the second embodiment, because the sealing devices 80 are provided at both the first and second rollers 42 and 52. Other configurations of the third embodiment are identical to those of the second embodiment. The rotary compressor of the third embodiment can minimize the introduction of a refrigerant or oil into the first compressing chamber 31 while an idling-rotation operation is performed in the first compressing chamber 31, and can minimize the leakage of a refrigerant from the respective compressing chambers 31 and 32 while a compressing operation is performed in both the first and second compressing chambers 31 and 32. Accordingly, the rotary compressor of the third embodiment can achieve a further improvement in compression efficiency.

Figure 10:
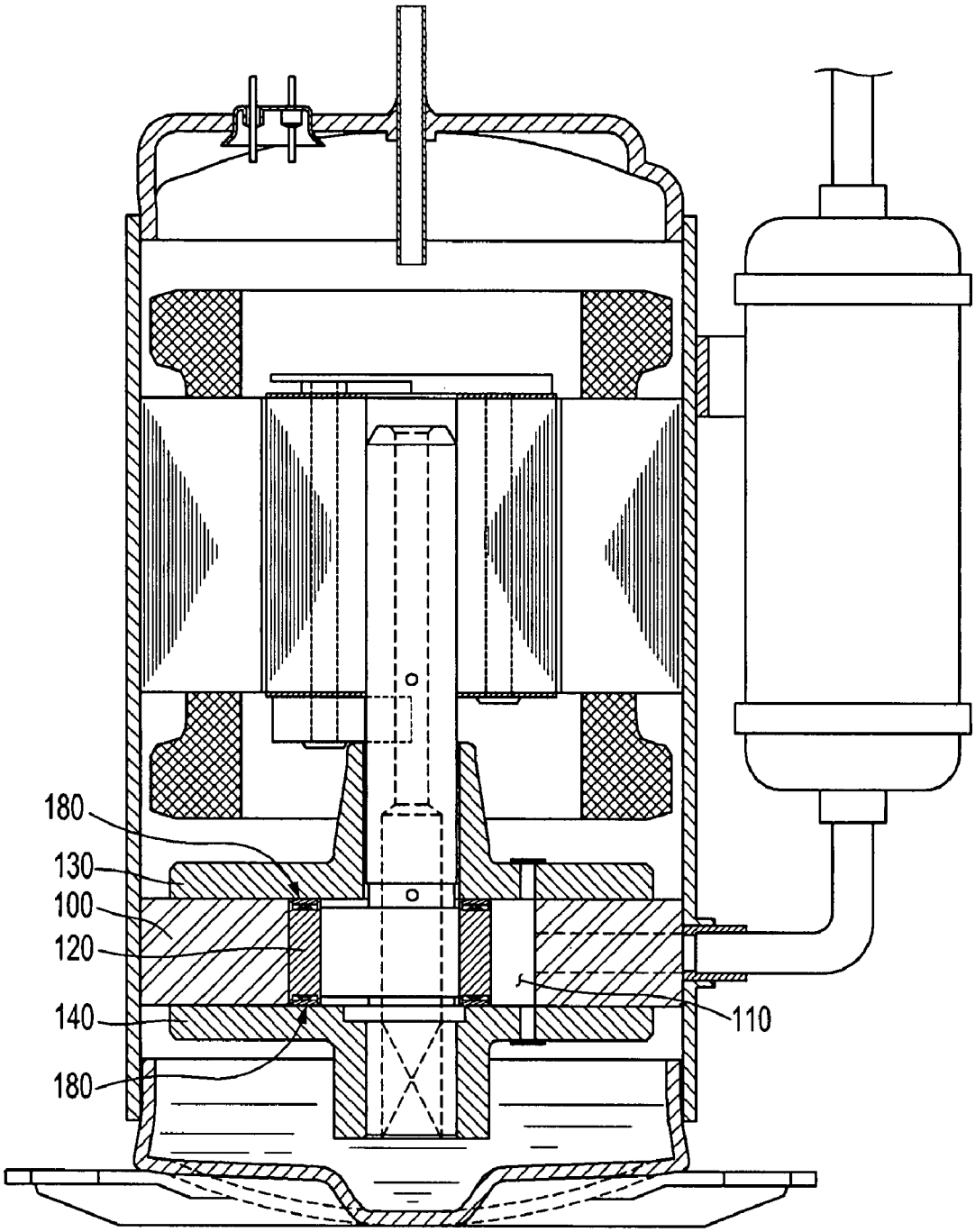
FIG. 10 is a sectional view of the rotary compressor in accordance with a fourth embodiment of the present invention.

FIG. 10 illustrates a rotary compressor in accordance with a fourth embodiment of the present invention. The rotary compressor of the fourth embodiment includes a housing 100 having a single compressing chamber 110, a roller 120 installed in the compressing chamber 110, and first and second flanges 130 and 140 to close the compressing chamber 110. Two sealing devices 180, each having the same configuration as that of the second embodiment, are installed at the top and bottom of the roller 120, respectively. The rotary compressor of the fourth embodiment can improve the sealing efficiency of the compressing chamber 110 by use of the sealing devices 180 installed, respectively, at the top and bottom of the roller 120, and consequently, can minimize the leakage of a refrigerant during a compressing operation, resulting in an improvement in compression efficiency.

As apparent from the above description, the embodiments of the present invention provide a rotary compressor capable of improving the seal of a compressing chamber by use of a sealing device. The rotary compressor has the effect of minimizing the leakage of a refrigerant from the compressing chamber while a compressing operation is performed in the compressing chamber, and resulting in an improvement in compression efficiency.

Further, according to the embodiments of the present invention, by virtue of a structure in which a gap defined at an end of a first roller inside the first compressing chamber is smaller than a gap defined at an end of a second roller inside a second compressing chamber, or with the use of the sealing device installed to the first roller, the sealing effect of the first compressing chamber can be improved. As a result, the rotary compressor has the effect of minimizing the introduction of a refrigerant or oil into the first compressing chamber (i.e. one compressing chamber of a variable-capacity multiple rotary compressor performing an idling-rotation operation).

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A rotary compressor comprising:

a housing defining first and second compressing chambers separated from each other;

first and second flanges coupled to the housing, to close the first and second compressing chambers, respectively;

an intermediate plate to separate the first and second compressing chambers from each other;

first and second rollers rotatably installed in the first and second compressing chambers, respectively;

first and second vanes installed to reciprocate in a radial direction of the first and second compressing chambers, to divide the first and second compressing chambers, respectively; and a vane control device to control the reciprocating of the first vane by use of a suction pressure and a discharge pressure, to vary a compression capacity, wherein a first gap, defined at an end of the first roller between the first roller and the first flange, is smaller than a second gap defined at an end of the second roller between the second roller and the second flange.

2. The rotary compressor according to claim 1, wherein the width of the first gap (d1) is determined on the basis of the equation $d1=d2*[1-V1/(V1+V2)]$, where d2 is the width of the second gap, V1 is the volume of the first compressing chamber, and V2 is the volume of the second compressing chamber.

3. The rotary compressor according to claim 1, wherein the vane control device comprises:

a control valve to selectively apply the discharge pressure or the suction pressure into a space defined at a rear side of the first vane;

a connection channel to connect the control valve to the space at the rear side of the first vane;

a high-pressure channel to connect the control valve to a discharge side of the compressor; and a low-pressure channel to connect the control valve to a suction side of the compressor.

* * * * *